US008426709B2

(12) United States Patent
Zervas et al.

(10) Patent No.: US 8,426,709 B2
(45) Date of Patent: Apr. 23, 2013

(54) ADJUSTABLE NECK-ANGLE JOINT FOR STRINGED MUSICAL INSTRUMENT

(76) Inventors: Christos Zervas, Athens (GR); Sofia Kourou, Athens (GR)

( * ) Notice: Subject to any disclaimer, the term of this patent is extended or adjusted under 35 U.S.C. 154(b) by 0 days.

(21) Appl. No.: 13/130,759

(22) PCT Filed: Dec. 15, 2009

(86) PCT No.: PCT/GR2009/000067

§ 371 (c)(1),
(2), (4) Date: May 24, 2011

(87) PCT Pub. No.: WO2010/070363

PCT Pub. Date: Jun. 24, 2010

(65) Prior Publication Data

US 2011/0226113 A1 Sep. 22, 2011

(30) Foreign Application Priority Data

Dec. 16, 2008 (GR) ..... 080100799

(51) Int. Cl.
*G10D 3/00* (2006.01)

(52) U.S. Cl.
USPC ..... 84/293

(58) Field of Classification Search ..... 84/293
See application file for complete search history.

(56) References Cited

U.S. PATENT DOCUMENTS

| | | | | | |
|---|---|---|---|---|---|
| 357,270 | A | * | 2/1887 | Cubley | 84/269 |
| 1,707,192 | A | * | 3/1929 | Overton | 84/267 |
| 1,755,019 | A | * | 4/1930 | Parker, Jr. | 84/293 |
| 3,550,496 | A | * | 12/1970 | Fender | 84/293 |
| 3,678,795 | A | * | 7/1972 | Fullerton | 84/293 |
| 4,027,570 | A | * | 6/1977 | Rendell et al. | 84/293 |
| 4,111,093 | A | * | 9/1978 | Field et al. | 84/267 |
| 4,856,403 | A | * | 8/1989 | Davies | 84/291 |
| 4,905,563 | A | * | 3/1990 | Davies | 84/291 |
| 4,982,640 | A | * | 1/1991 | Buscarino | 84/293 |
| 5,886,272 | A | | 3/1999 | Regenberg | |
| 6,028,255 | A | * | 2/2000 | Myronyk | 84/293 |
| 6,194,645 | B1 | * | 2/2001 | Rose | 84/313 |
| 6,265,648 | B1 | * | 7/2001 | Steinberger | 84/293 |

(Continued)

OTHER PUBLICATIONS

International Search Report, Mar. 26, 2010, from International Phase of the instant application.

*Primary Examiner* — David Warren
*Assistant Examiner* — Robert W Horn
(74) *Attorney, Agent, or Firm* — Jackson Patent Law Office

(57) ABSTRACT

Adjustable neck-angle joint for stringed musical instrument, directed to the technique and the way of joining the neck (12) and the body (13) of a stringed musical instrument. The two parts are joined together with the use of screws. At their contact points they include a convexo-concave formation (15), (14) which provides absolute contact between the instrument's body (13) and the neck (12) with the ability to rotate laterally in a predetermined manner. Thus making possible to change the angle between the longitudinal axis of the neck (12) and the longitudinal axis of the instrument's body (13). The neck (12) is changing its angular position relative to the instrument's body (13) regulating the space between the strings and the upper surface of body, as well as the asked force on the top an acoustic musical instrument or the body of an electric musical instrument, by its strings. The instrument can be easily setup according to the player's personal preferences, such as the "action" and the desirable instrument natural resonance.

6 Claims, 11 Drawing Sheets

U.S. PATENT DOCUMENTS

| | | | | |
|---|---|---|---|---|
| 6,353,164 | B1 * | 3/2002 | Corsi | 84/293 |
| 6,831,218 | B2 * | 12/2004 | Steinberger | 84/293 |
| 7,476,790 | B2 * | 1/2009 | Breedlove et al. | 84/293 |
| 7,557,281 | B1 * | 7/2009 | Campling | 84/293 |
| 7,816,592 | B2 * | 10/2010 | Babicz | 84/293 |
| 7,838,750 | B2 * | 11/2010 | Steinberger | 84/293 |
| 7,932,448 | B1 * | 4/2011 | Bochar, Jr. | 84/267 |
| 7,932,449 | B1 * | 4/2011 | Minakuchi | 84/293 |
| 2008/0092716 | A1 | 4/2008 | Breedlove et al. | |
| 2011/0226113 | A1 * | 9/2011 | Zervas et al. | 84/293 |

* cited by examiner 20
12
13
21

12
13
21
20

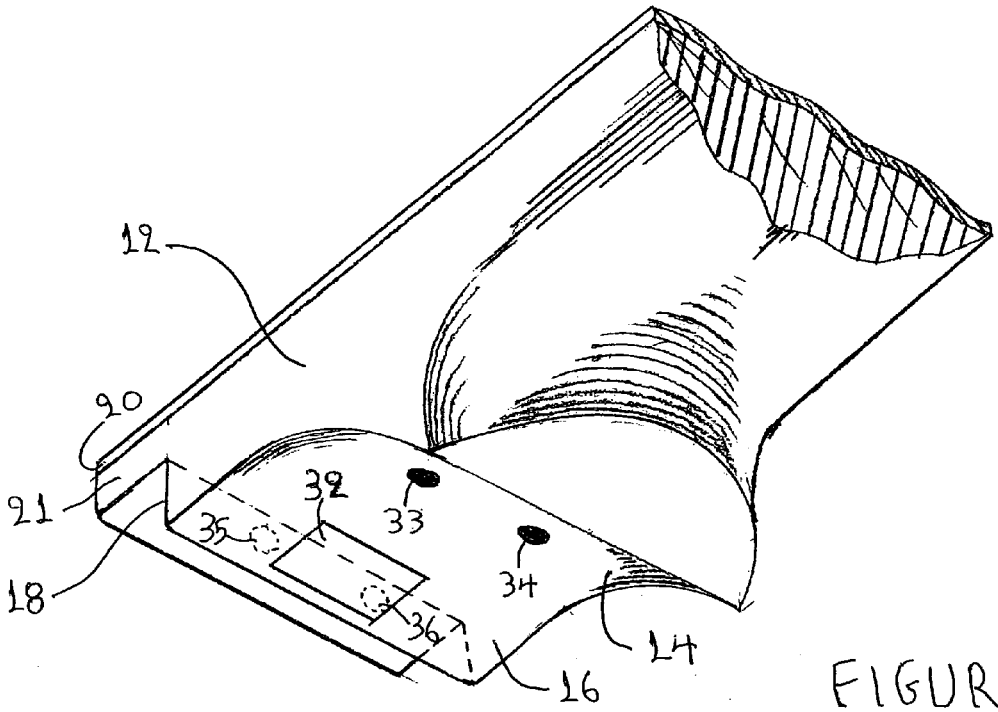
FIGURE 5
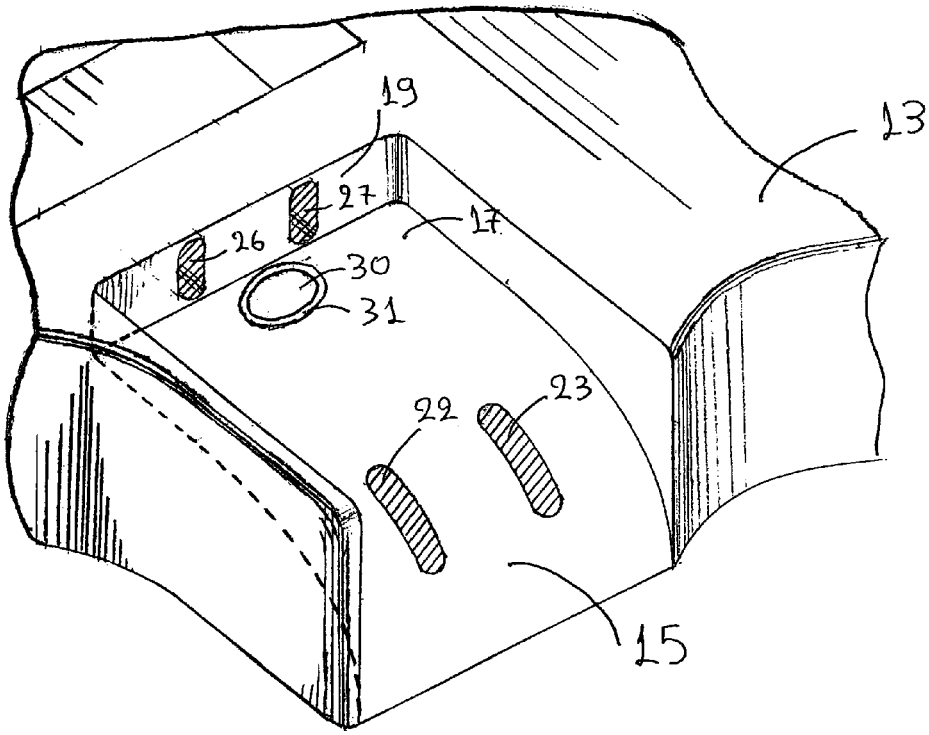

ADJUSTABLE NECK-ANGLE JOINT FOR STRINGED MUSICAL INSTRUMENT

The invention is directed to the technique and the way of joining the neck and the body of a stringed musical instrument, often referred to as "neck-joint". The neck is mounted to the instrument body in a manner so that the orientation of the neck can be adjusted. The invention is applicable to stringed musical instruments which have an instrument body and an elongated neck along which the strings are stretched, such as electric guitars, acoustic guitars, banjos, mandolins, violins and other similar instruments.

There are many types of the neck-joint techniques between the neck and the body of a stringed musical instrument. Usually, the neck is either glued with the body of the instrument, often referred to as "set-neck" joint, held in place with screws, often referred to as "bolt-on" joint, or extends completely through the instrument, often referred to as "neck-through" joint. The angle between the neck and the body, often referred to as "neck-angle", varies in order to achieve the desired space between the strings and the upper surface of body. The force asked on the top of an acoustic musical instrument or the body of an electric musical instrument is proportionate to the space mentioned above. The force asked, considerably affects the natural sound of the musical instrument.

With the already existing neck-joint methods, the neck-angle is fixed, and no regulation or adjustment is possible. As a result, the above mentioned force and the natural sound of the instrument are always invariable. Also, the instrument setup to the personal preferences of the player is performed exclusively from the instrument bridge or the saddles. Such a setting is the regulation of the distance between strings from fingerboard. This distance is often mentioned as "action".

An advantage of this invention is that the spacing between the strings and the upper surface of body, as well as the asked force on the top an acoustic musical instrument or the body of an electric musical instrument, can be regulated according to the player's personal preferences and the desirable resonance. The "action" can be regulated by changing neck-angle, either by tilting the neck downwardly to the instrument body for a lower "action" or upwardly for a higher "action". Thus giving the possibility to maintain the height of the instrument bridge. It is even possible to mount completely different types of bridges on the same musical instrument.

Many of the bolt-on joint advantages are also offered, such as the easy neck replacement in case of damage, repair, or replacement with an other specifications' neck.

The adjustable neck angle joint, according to the present invention, is a bolt-on joint, with the neck connected to the instrument body by the use of screws. It has the characteristic that a part of the joint's contact area on the side of the body is a convex cylindrical shape with an axis parallel to the width of body and that the part of the joint's contact area on the side of the neck that is in contact with it, is a similar concave cylindrical shape, with an axis also parallel to the width of body. This can be reversely built, with the concave shape on the side of the body and the convex shape on the side of the neck. When the neck joins the body, these cylindrical shapes are linked and a convexo-concave joint is created which provides absolute contact between the instrument body and the neck with the ability to rotate laterally in a predetermined manner, adjusting the angular position of the neck relative to the instrument body.

When the neck-joint has no neck-angle, with the neck parallel to the upper body surface, all the joint's shapes and surfaces on the side of the neck are in contact with the similar shapes and surfaces on the side of the body. When there is a neck-angle at the neck-joint some of the joint's surfaces on the side of the neck are not in contact with the similar surfaces on the side of the body. The convexo-concave shapes, as well as the side, vertical to the joint, surfaces, are always in a firm contact.

Characteristic advantage of this invention is that the "in-joint" surfaces form a wide contact area between the neck and the body, even when a neck-angle is featured, giving a very good vibration and oscillation transmission that makes the instrument very resonant. This is a very important factor for the quality of a stringed musical instrument.

According to the invention, the neck is mounted to the body with screws. The number and type of which depends on factors such as the type of the musical instrument, its size and weight, the available space in the joint area and the desirable strength of the joint in general.

The invention requires the existence of channels either on the neck's or the body's side, within the joint. The mounting screws are sufficiently long in order to penetrate these channels while they are constantly fixed in the other joint's part. While changing the neck-angle, they move along the axis of the channels. When tightened, they stabilize the joint in the desirable neck-angle.

Characteristic of the present invention is the existence of at least one screw which determines the distance between the joint's parts that are not in contact, when there is a neck-angle. This screw is pivoting the neck in order to change the angle between the longitudinal axis of the neck and the longitudinal axis of the instrument body. This screw provides additional stability, opposing to the force of the strings that tends to align the body and the neck. This stabilizing screw is threaded and mounted in a threaded insert or nut which is constantly fixed either on the body or the neck. It is positioned on the flat surfaces of the joint. It is not positioned on the convexo-concave sides or on vertical to the joint surfaces because of their constant firm contact.

The head of the above mentioned stabilizing screw can be reached either from an internal side of joint or the outer side of the instrument. In the first case, the screw adjustment is performed before mounting the neck to the body. In the second case, the screw adjustment can be also performed with neck mounted on the body, only by loosening the mounting screws. This screw is being accessed either through a hole in a part of the instrument or through the hollow sound chamber, in case of an acoustic instrument.

Another characteristic of the present invention is the existence of at least one metal or plastic pressure plate, located on the part against the touching point of the stabilizing screws, providing a bearing surface for their load in order to prevent any damage.

The invention is described below with the help of examples and with reference to the attached figures, on which:

Figure 1:
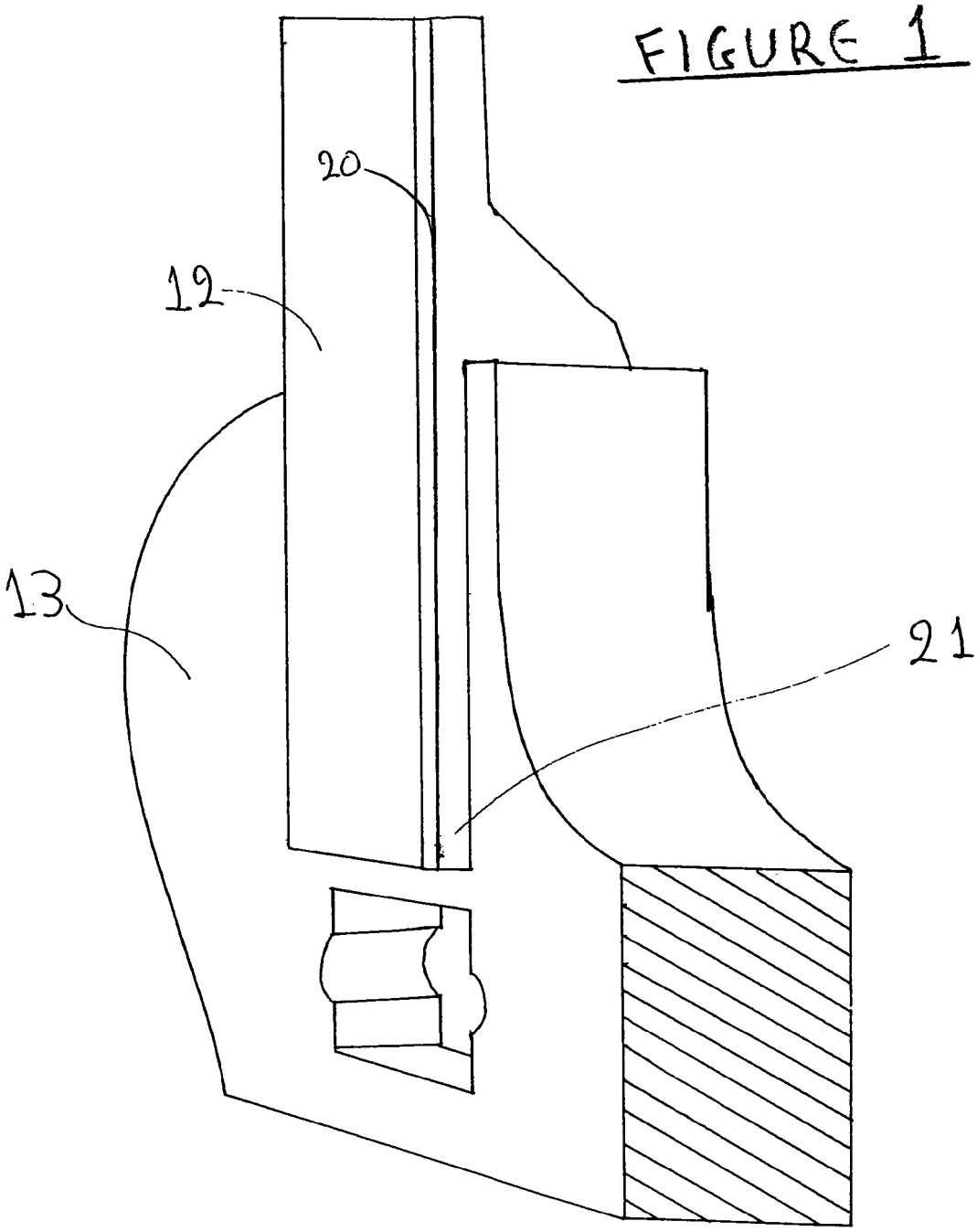
FIG. 1 is a perspective view of a portion of an electric guitar incorporating the present invention, featuring no neck-angle between the neck (12) and the body (13) of the guitar.
Figure 2:
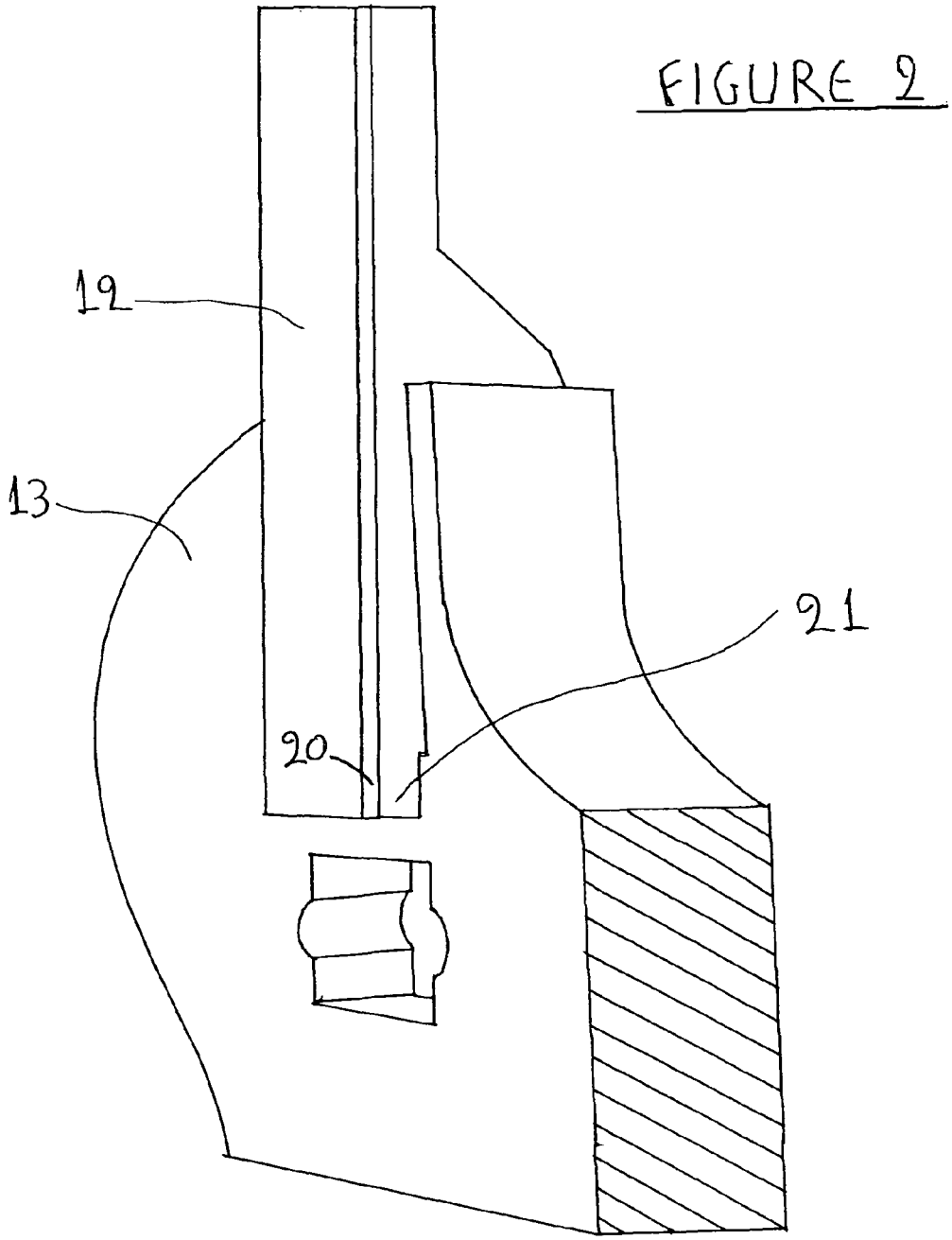
FIG. 2 is a perspective view of a portion of an electric guitar incorporating the present invention, featuring a 3' degree neck-angle between the neck (12) and the body (13) of the guitar.
Figure 3:
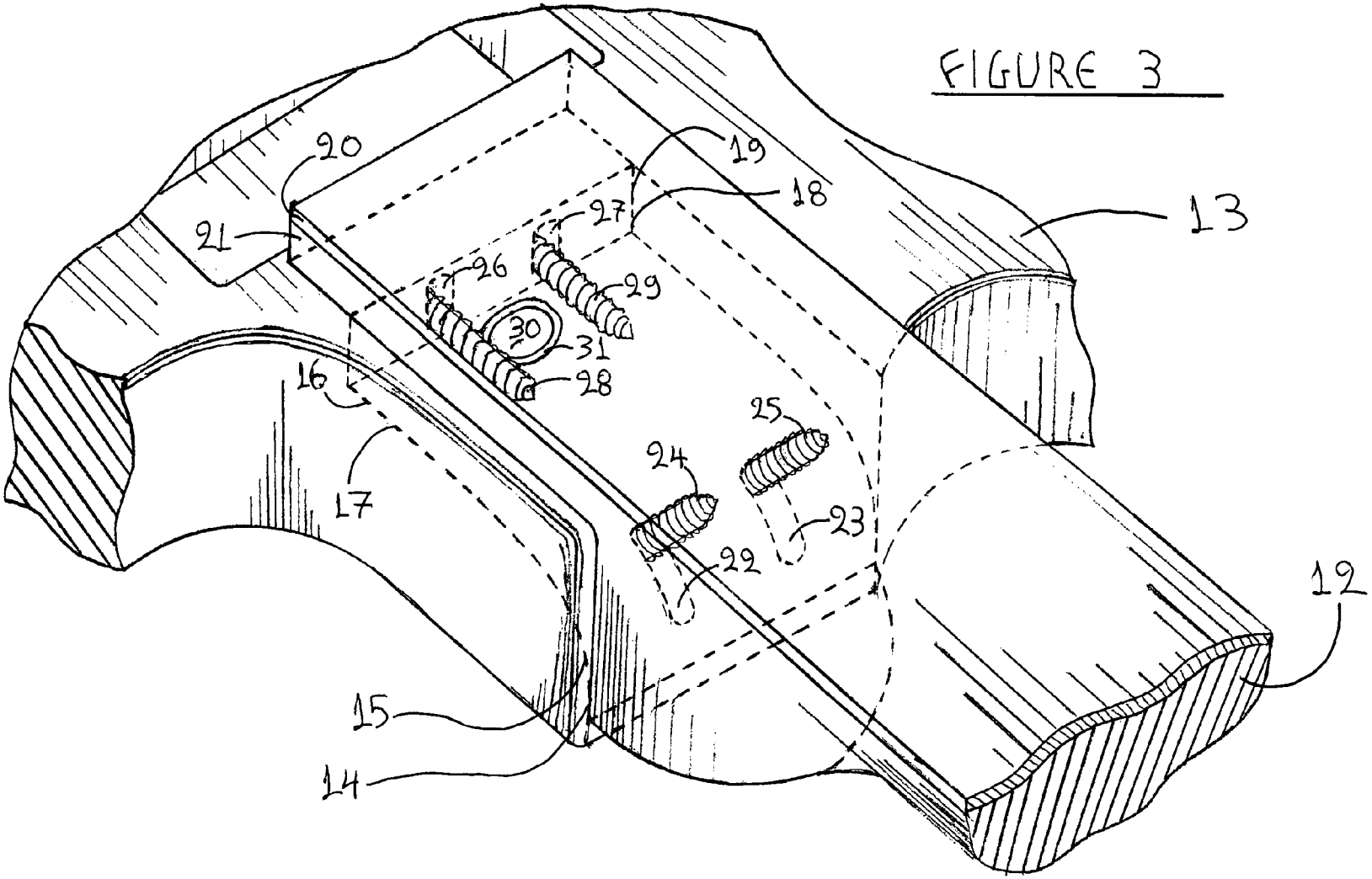
Figure 4:
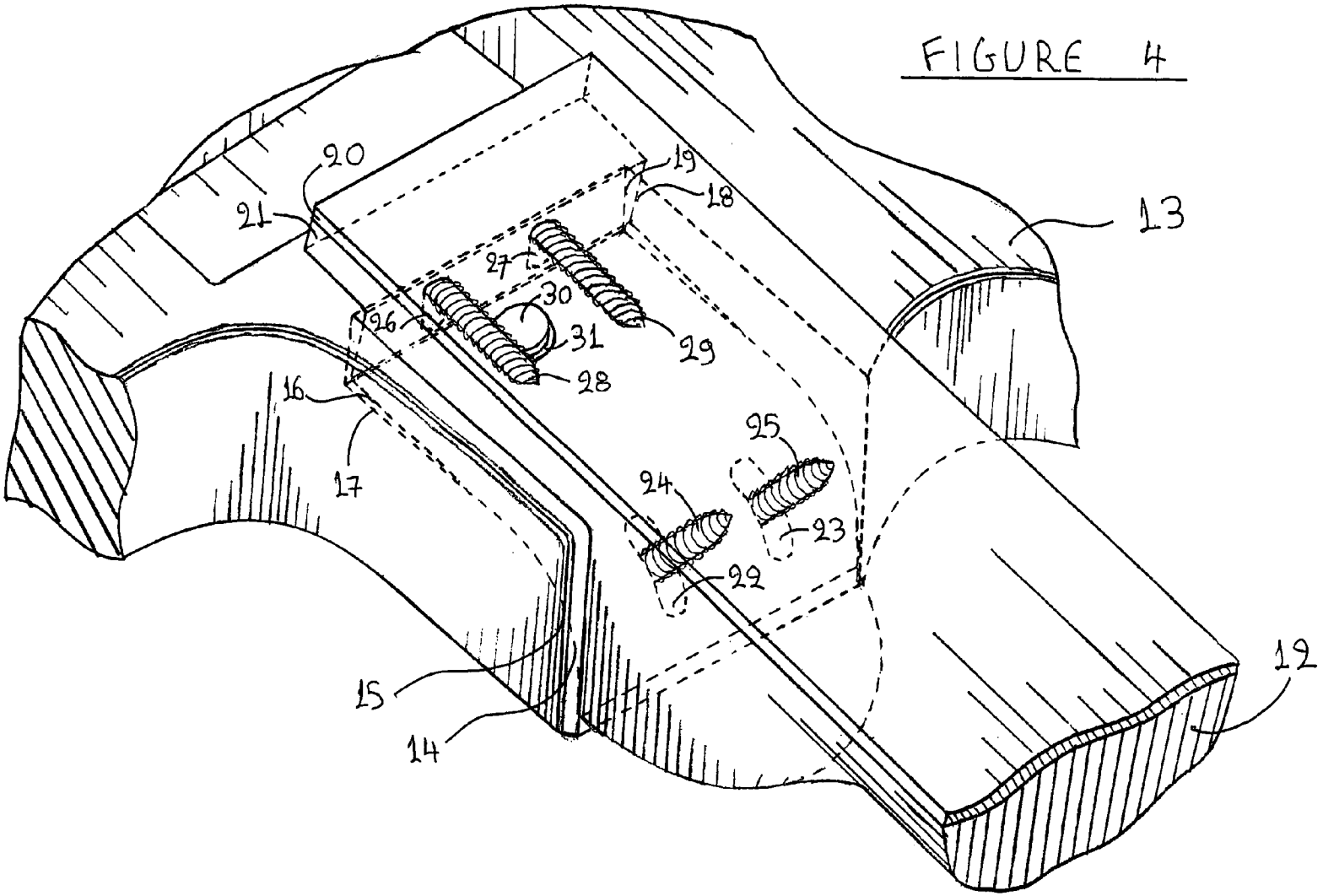

FIGS. 3 and 4 are views of a portion of an electric guitar incorporating the present invention. In FIG. 3 the neck (12) joins the body (13) with no neck-angle. In FIG. 4 the neck (12) joins the body (13) with a 3' degree neck-angle. These figures are illustrating the convex cylindrical shape of the joint (15), on the guitar's body (13), in which are located channels (22), (23), and mounting screws (24), (25). These figures are also illustrating surface (19), in which are located channels (26), (27), and mounting screws (28), (29) as well as surface (17), in which is located the stabilizing screw (30).

FIG. 5 is a perspective view of the same as in FIGS. 3 and 4 portion of an electric guitar, incorporating the present invention and presenting the neck (12) and the body (13) separately. It is illustrating the concave cylindrical shape of the joint (14), on the guitar's neck (12), in which are located holes (33), (34) for mounting screws (24), (25). It is also illustrating part (18), in which are located holes (35), (36) for mounting screws (28), (29), as well as surface (16), in which is located the metal plate (32).

Figure 6:
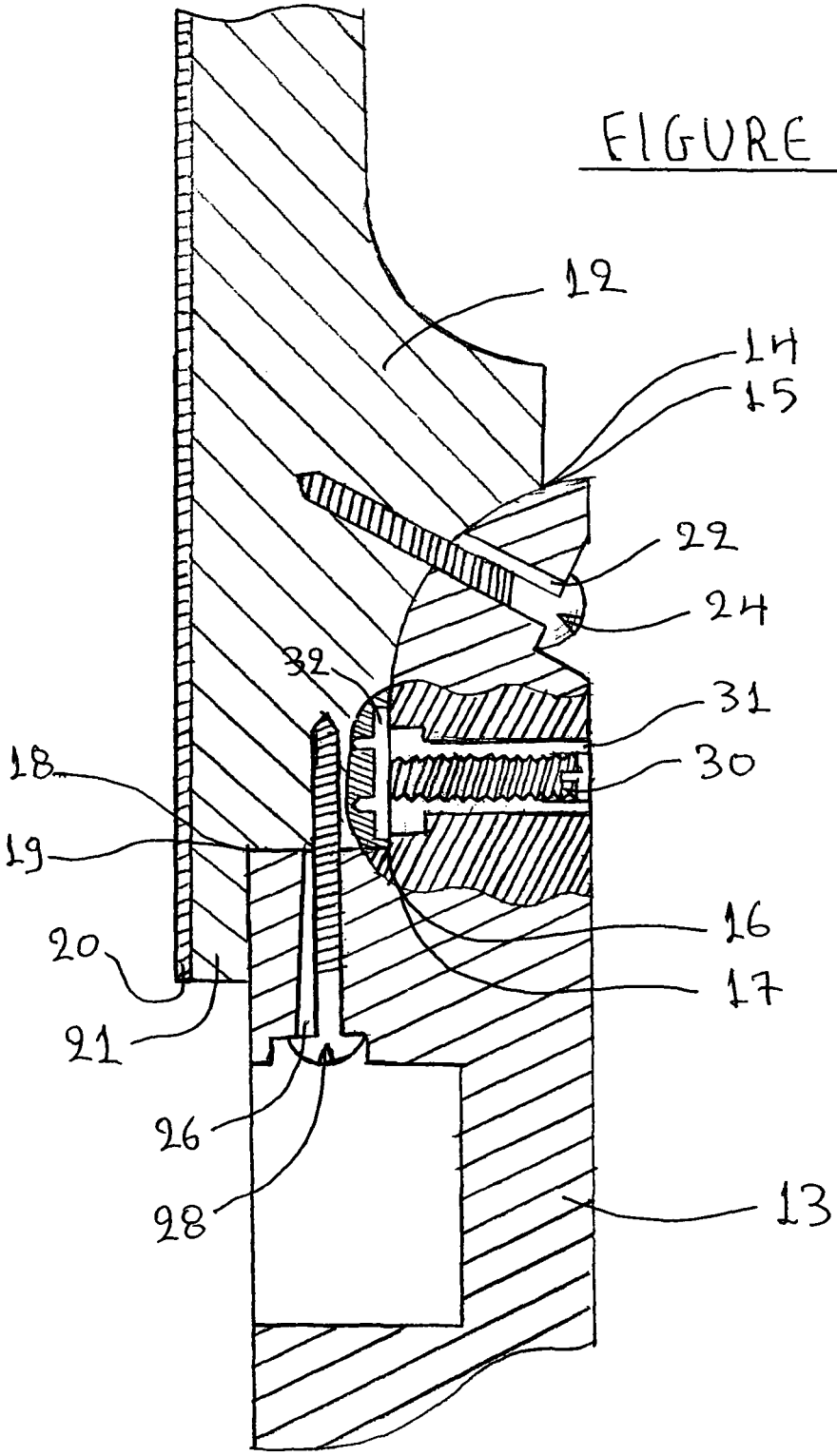
Figure 7:
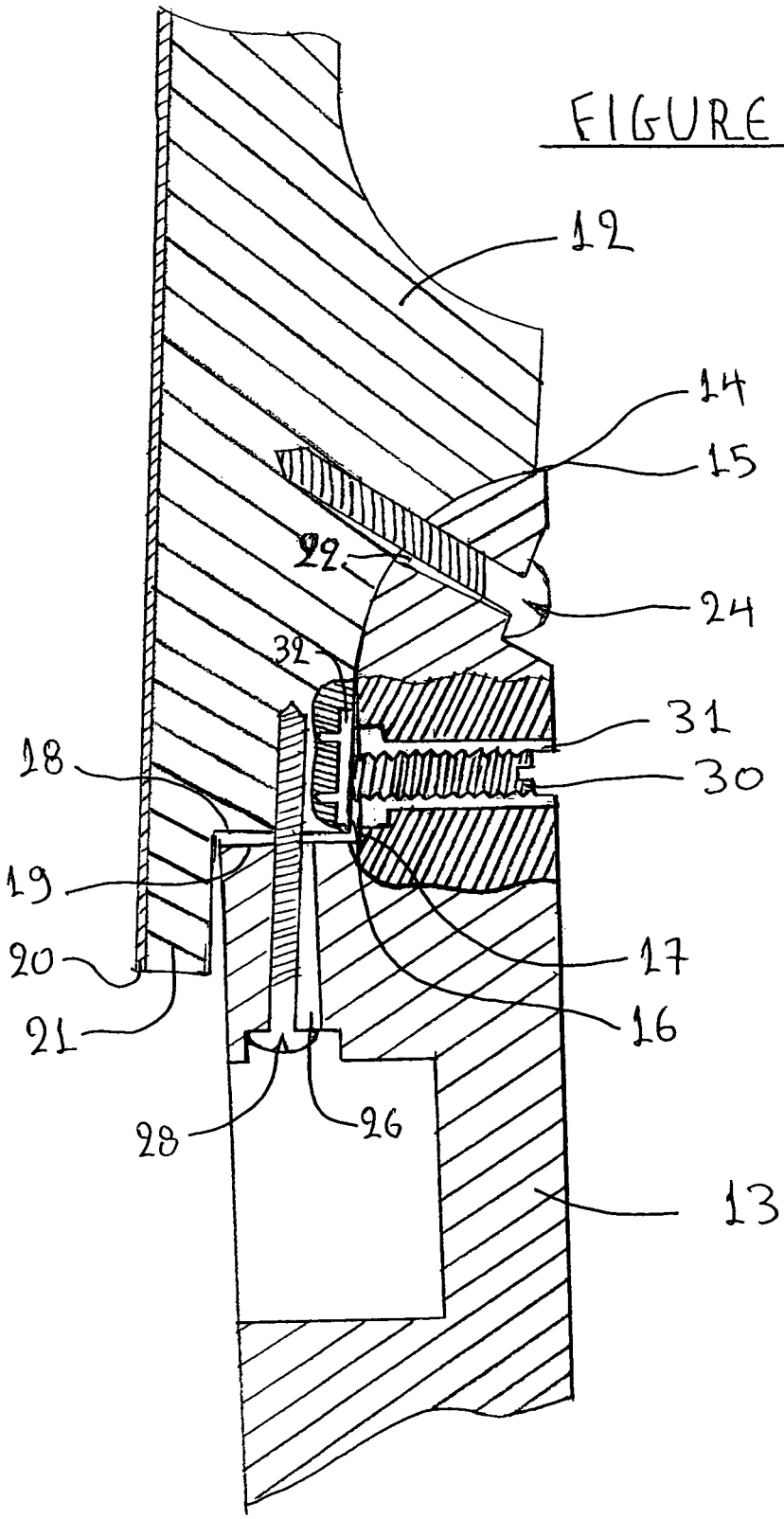

FIGS. 6 and 7 are side sectional views of a portion of an electric guitar incorporating the present invention. In FIG. 6 the neck (12) joins the body (13) with no neck-angle. In FIG. 7 the neck (12) joins the body (13) with a 3' degree neck-angle. There are two sections done vertically to the neck-joint. One is intersecting channels (22), (26) and mounting screws (24), (28) and the other is intersecting the stabilizing screw (30), the threaded insert (31) and the pressure plate (32). The stabilizing screw (30) has been placed on surface (17) of the body (13) opposing surface (16) of the neck (12), where has been positioned the pressure plate (32) in order to protect and prevent any damage caused by the load of the stabilizing screw (30). These figures are illustrating the positioning of mounting screws (24), (28) within the channels (22), (26) proportionately to the neck-angle. The stabilizing screw (30) is accessible from the back of the body (13). Surfaces (14) and (15) are in firm contact. When there is no neck-angle, surfaces (14), (15), (16), (17), (18), (19) are all in firm contact and part (21) with the fingerboard (20) lean on the top of the guitar's body (13).

Figure 8:
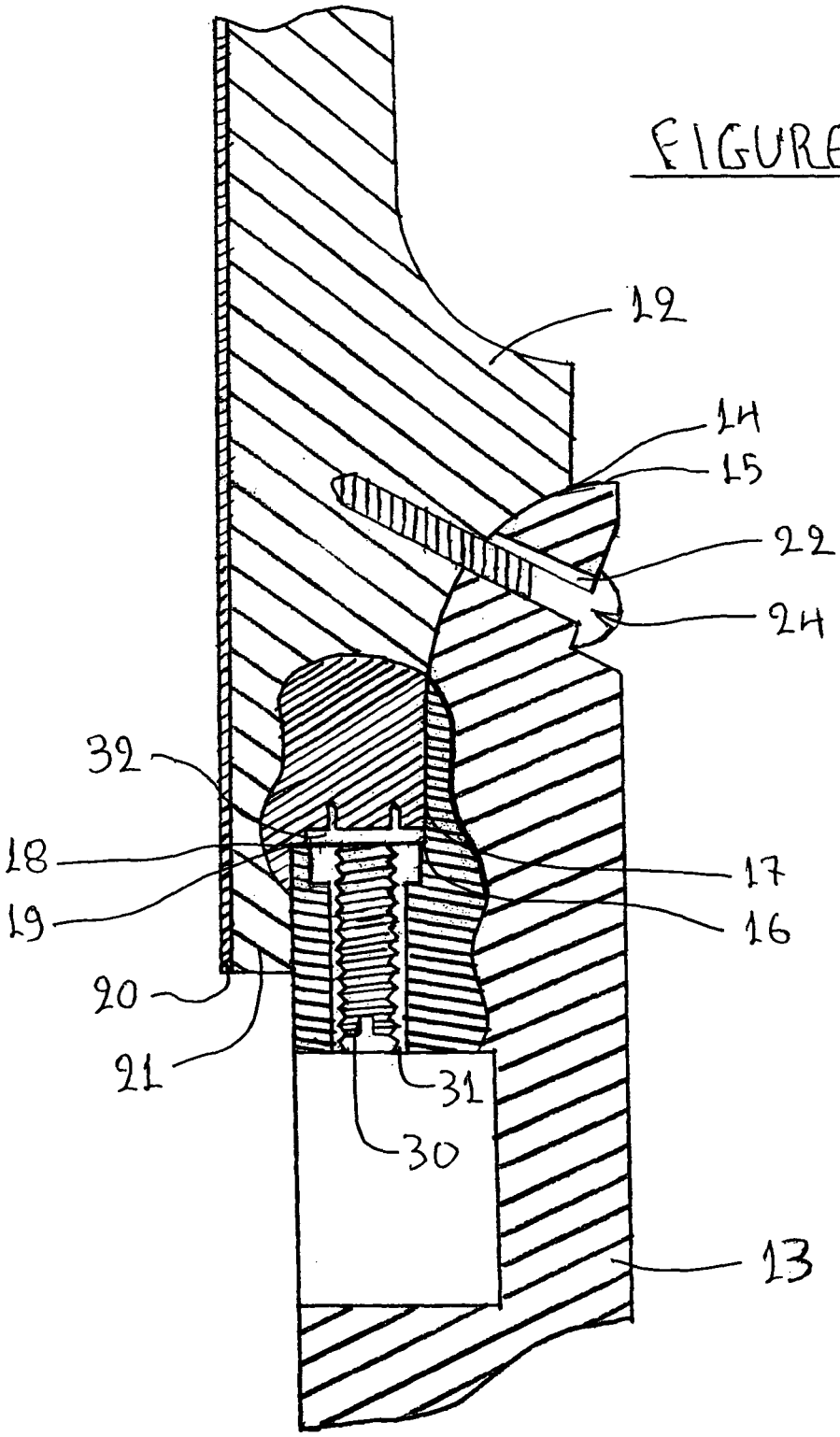
Figure 9:
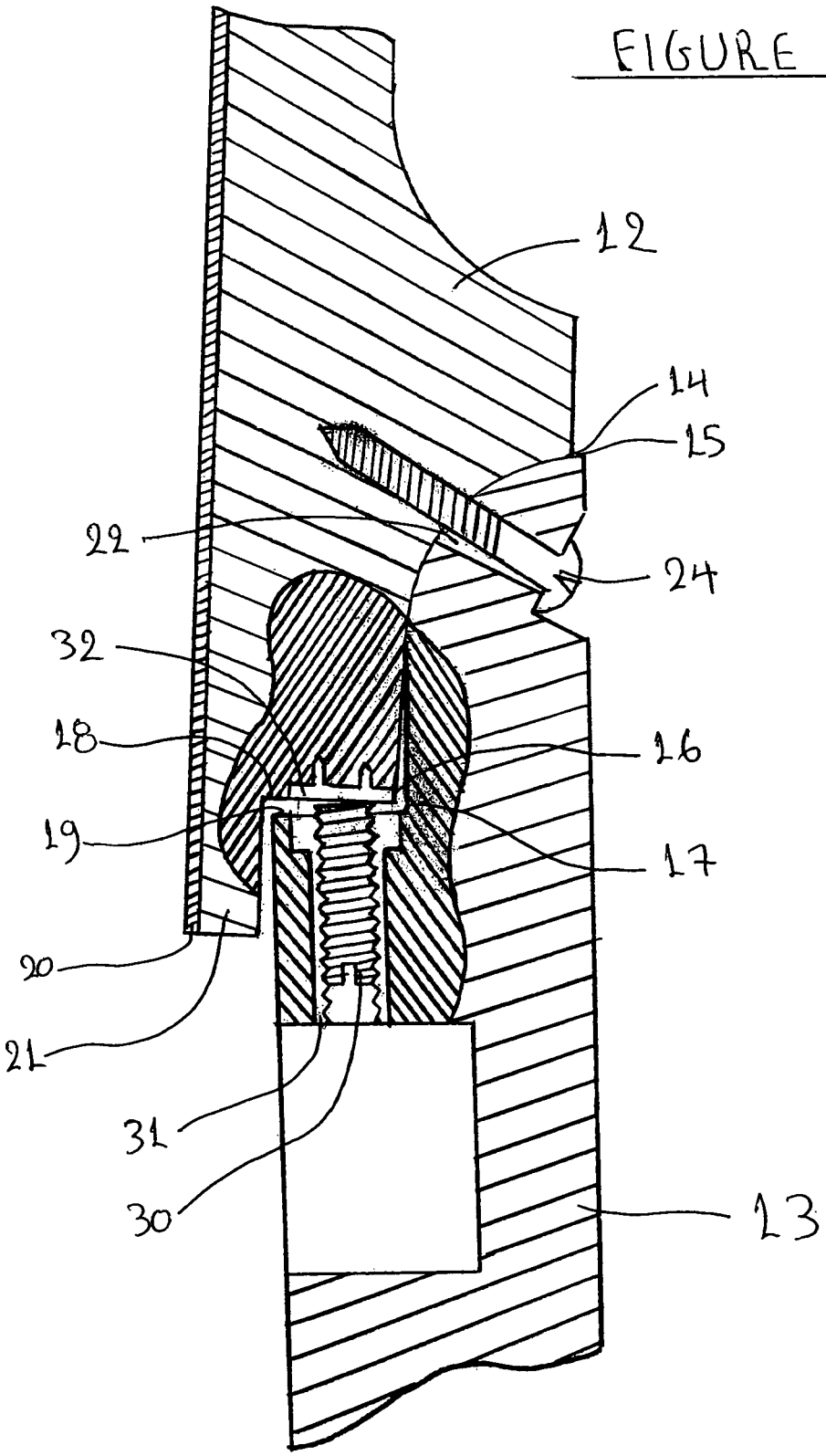

FIGS. 8 and 9 are side sectional views of a portion of an electric guitar incorporating the present invention. In FIG. 8 the neck (12) joins the body (13) with no neck-angle. In FIG. 9 the neck (12) joins the body (13) with a 3' degree neck-angle. There are two sections done vertically to the neck-joint. One is intersecting channel (22) and mounting screw (24) and the other is intersecting the stabilizing screw (30), the threaded insert (31) and the pressure plate (32). The main difference relative to FIGS. 6 and 7 is in that the stabilizing screw (30) has been positioned in such a manner that exceeds surface (19) of the body (13), opposing surface (18) of the neck (12) and contacting the pressure plate (32). Pressure plate (32) is positioned on surface (18).

Figure 10:
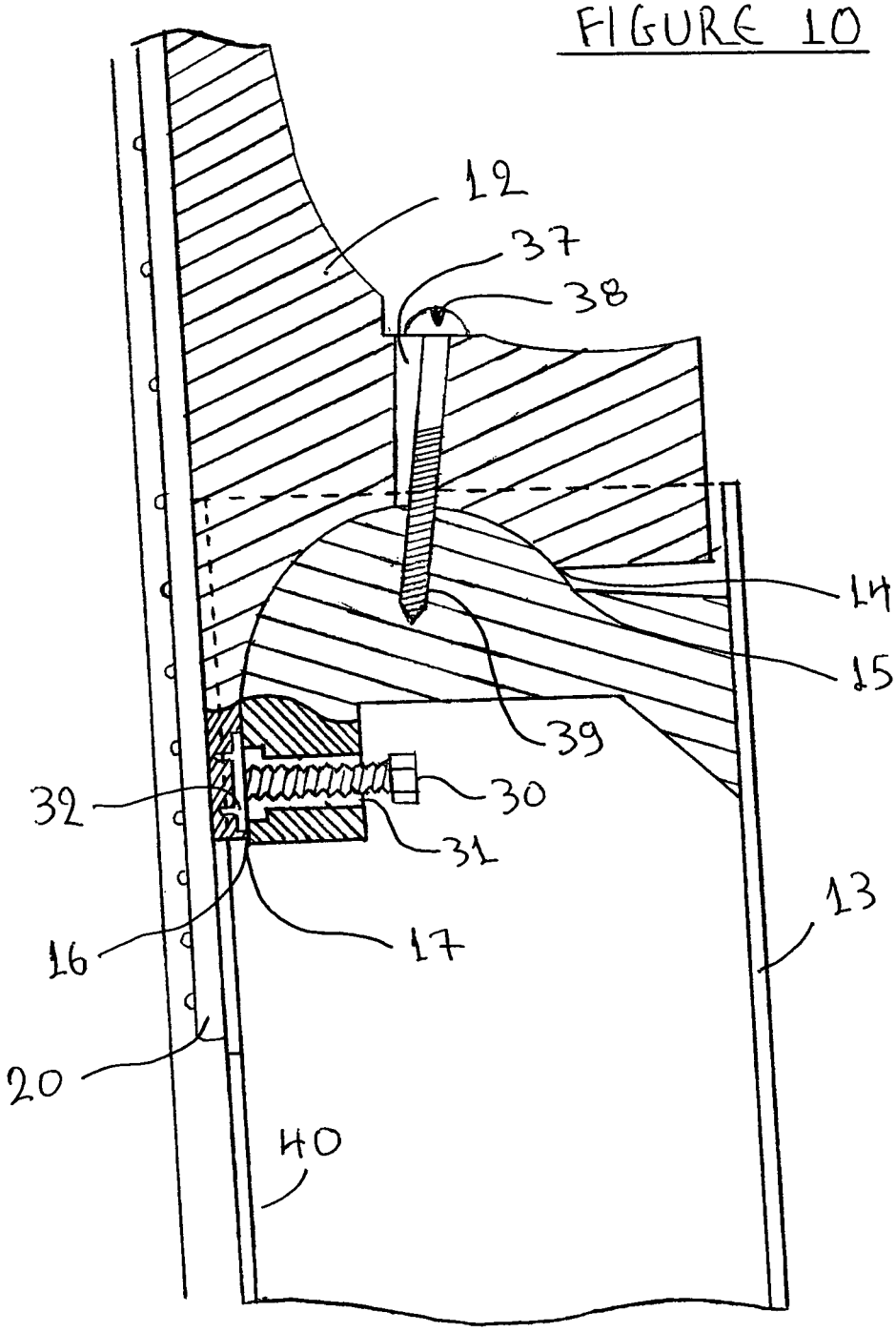
Figure 11:
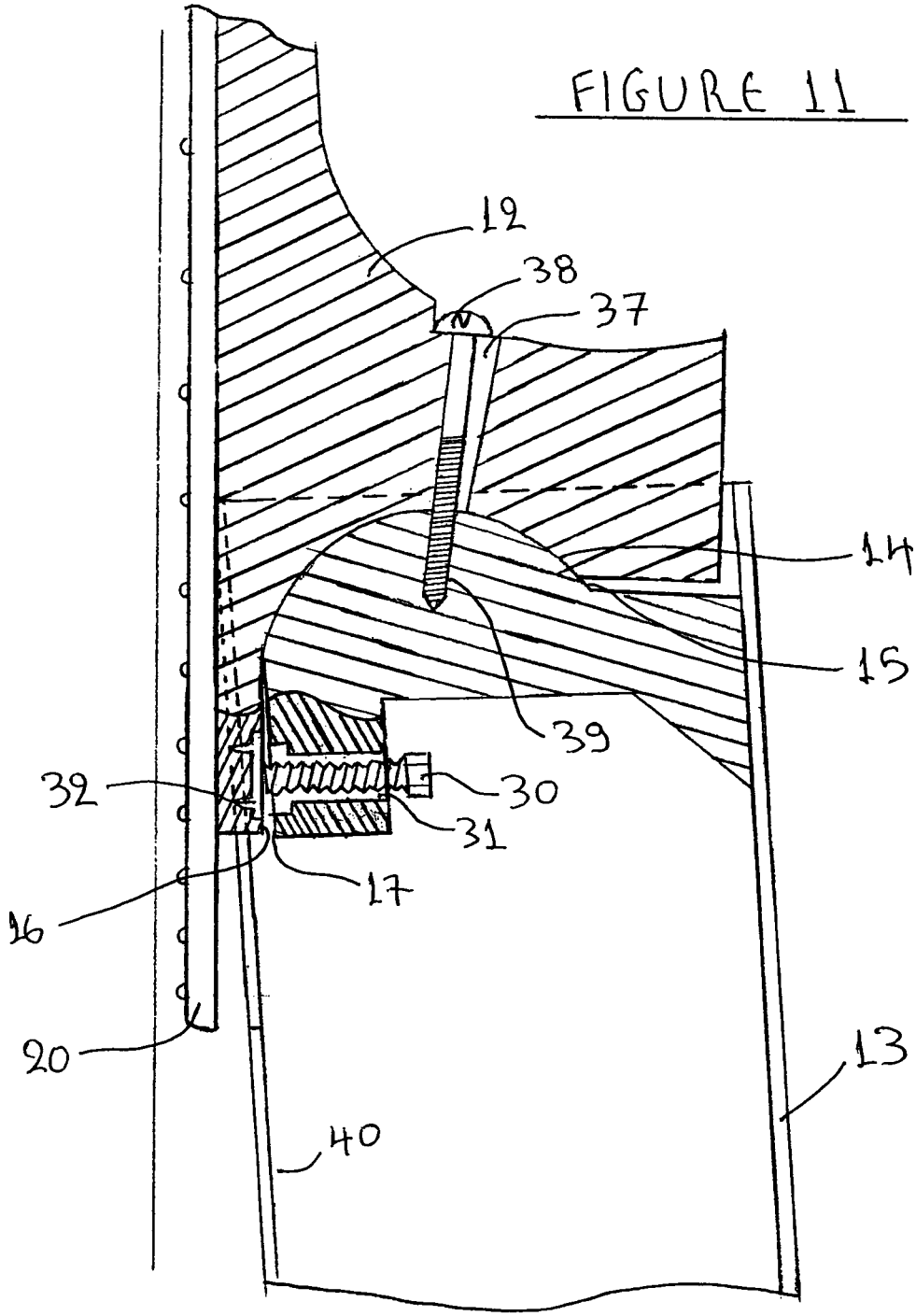

FIGS. 10 and 11 are side sectional views of a portion of an acoustic guitar incorporating the present invention. In FIG. 10 the neck (12) joins the body (13) with no neck-angle. In FIG. 11 the neck (12) joins the body (13) with a 2' degree neck-angle. These figures are illustrating the convex cylindrical shape of the joint (15), on the guitar's body (13), in which is located hole (39), as well as the concave cylindrical shape of the joint (14), on the guitar's neck (12), in which is located channel (37). They are also illustrating the stabilizing screw (30) and the threaded insert (31) which are positioned on surface (17) opposing surface (16) of the neck (12), contacting the pressure plate (32). Pressure plate (32) is positioned on surface (16). There are two sections done vertically to the neck-joint. One is intersecting channel (37), hole (39) and mounting screw (38) and the other is intersecting the stabilizing screw (30), the threaded insert (31) and the pressure plate (32). These figures are also illustrating the positioning of mounting screw (38) within channel (37) proportionately to the neck-angle. In this case the stabilizing screw (30) is being accessed through the sound hole (40) and mounting screw (38) is being accessed from the back side of the neck (12). Surfaces (14) and (15) are in firm contact. When there is no neck-angle, surfaces (14), (15), (16), (17), are all in firm contact and the fingerboard (20) leans on the top of the guitar's body (13).

In case the invention is embodied in an electric guitar, such as in FIGS. 1,2,3,4,5,6,7,8 and 9, part of the neck (21) with the fingerboard (20) is extending over the joint, in order to cover aesthetically the small gap that is created, between surfaces (18) and (19), when there is a neck-angle. Similarly and for the same reason, in FIGS. 10 and 11, this role is being performed by the fingerboard (20).

The invention claimed is:

1. An adjustable neck-joint musical instrument comprising:

a body defining a width;

a neck defining a longitudinal axis, a convex cylindrical part defined by one of the body or the neck;

a concave cylindrical part defined by the other of the body or the neck, the convex cylindrical part abutting the concave cylindrical part thereby forming a convexo-concave joint;

a plurality of channels defined by one of the convex cylindrical or the concave cylindrical parts; and a plurality of mounting screws fixed to the other of the convex cylindrical or the concave cylindrical parts, wherein the plurality of channel are parallel to the longitudinal axis, and each mounting screw penetrates one of the plurality of channels and is movable within the one of the plurality of channels, thereby enabling adjustment of an angular position defined by the body and the neck.

2. An adjustable neck-joint musical instrument according to claim 1 wherein the convex cylindrical part is defined by the neck, and the concave cylindrical part is defined by the body.

3. An adjustable neck-joint musical instrument according to claim 1 wherein a part of neck, or a fingerboard, or both are extending over the joint, in order to cover aesthetically a small gap that is created between surfaces, when there is an angle defined by the body and the neck.

4. An adjustable neck-joint musical instrument according to claim 1 wherein a number of channels is equal to a number of mounting screws.

5. An adjustable neck-joint musical instrument according to claim 1 further including a stabilizing screw which determines the distance between the joint's surfaces that are not in contact, when there is an angle defined by the body and the neck, the screw pivoting the neck in order to change the angle between the longitudinal axis of the neck and a longitudinal axis of the body, the screw providing additional stability, opposing to the force of the strings that tends to align the body and the neck, the screw being threaded and mounted in a threaded insert or nut which is constantly fixed either on the body or the neck.

6. An adjustable neck-joint musical instrument according to claim 5 further including a metal or plastic pressure plate providing a bearing surface for the stabilizing screw.

* * * * *